United States Patent [19]

McDaniel et al.

[11] Patent Number: 5,036,609

[45] Date of Patent: Aug. 6, 1991

[54] QUILTING BORDER HOOP HAVING A VARIABLE QUILT BINDING GAP

[76] Inventors: Jacqueline R. McDaniel; George C. McDaniel, both of 2087 Truett Cir., Thousand Oaks, Calif. 91360

[21] Appl. No.: 546,867

[22] Filed: Jul. 2, 1990

[51] Int. Cl.[5] ..... D05C 1/02; D05C 1/04

[52] U.S. Cl. ..... 38/102.2; 38/102.1

[58] Field of Search ..... 38/102, 102.1, 102.2, 38/102.3, 102.4, 102.5, 102.91

[56] References Cited

U.S. PATENT DOCUMENTS

| | | | |
|---|---|---|---|
| 623,301 | 4/1899 | Allen | 38/102.2 |
| 1,056,966 | 3/1913 | Belding | 38/102.2 |
| 1,221,123 | 4/1917 | Westhaver | 38/102.2 |
| 4,451,997 | 6/1984 | Jones | 38/102.2 |
| 4,485,574 | 12/1984 | Bennetot | 38/102.2 |
| 4,642,924 | 2/1987 | Sudderth et al. | 38/102.2 |
| 4,762,076 | 8/1988 | Wakaizumi | 38/102.2 X |

*Primary Examiner*—Werner H. Schroeder
*Assistant Examiner*—Ismael Izaguirre
*Attorney, Agent, or Firm*—Jack C. Munro

[57] ABSTRACT

A quilting border hoop which utilizes an elongated support rod upon which are mounted first and second U-shaped members with these members to be located in an aligned overlapping position forming a narrow gap therebetween. The outer U-shaped member includes an adjusting block assembly which when operated will vary the width of the narrow gap. A fabric strip is secured to the support rod. The quilt is to be attached to this fabric strip and then clamped between the U-shaped members to tightly bind in position the quilt facilitating sewing on the quilt. Where the U-shaped members are connected to the support rod, there is connected between the ends of the U-shaped members spacers so as to pre-establish the width of the narrow gap.

7 Claims, 1 Drawing Sheet

QUILTING BORDER HOOP HAVING A VARIABLE QUILT BINDING GAP

BACKGROUND OF THE INVENTION

The field of this invention relates to sewing of patterns on fabric, and more particularly to a border hoop that is to be used in conjunction with a border of a guilt when performing sewing operations on the quilt.

A quilt has long been known as a bed cover constructed of an inner layer of cloth and an outer layer of cloth with a stuffing material located therebetween. Common forms of such stuffing are down, cotton, wool, etc. The inner and outer layers of cloth are secured together through a series of stitches which are located in a lined arrangement to form a pattern.

It is common in the sewing of a quilt to utilize a pair of round hoops which are located in an overlapped arrangement tightly binding the quilt therebetween with a portion of the quilt being tightly stretched within the confined area of the overlapped hoops. It is within this area of the quilt that the sewing operation is performed. When the sewing operation is completed within the area confined by the hoops, the hoops are to be disengaged from the quilt and moved to a new position with the securing procedure repeated.

Round hoops work satisfactorily through most of the area of the quilt. However, when it comes to the border of the quilt, a different type of hoop needs to be employed and that is what is referred to as a border hoop. The border hoop, instead of being round, is generally U-shaped with the straight edge of the border to be attached to a strip of fabric which is secured to a support rod. The support rod is mounted across the apex area of the U-shaped border hoop.

In the past, such U-shaped border hoops were constructed of two U-shaped members which are mounted on the support rod. It is common for the members to just be mounted together with no pre-established spacing being arranged therebetween. There is no adjustability as to the spacing between the hoop members. Therefore, if the quilt is formed to have any significant amount of thickness, it is very difficult to bind the quilt in position between the hoop members. There is a strong need to construct a border hoop for quilting where the border hoop is adjustable to compensate for different thicknesses of quilts.

SUMMARY OF THE INVENTION

The structure of the present invention is directed to a border hoop that is to be used in quilting which is constructed of a pair of U-shaped members with there being an inner member and an outer member with these members being pivotally mounted on a single elongated support rod. The members are to be positionable and aligned in an overlapping arrangement forming a narrow gap therebetween. The outer hoop member is actually constructed of two separate members which are connected together through an adjusting block arrangement which provides for moving of the two separate members together or moving such apart to vary the spacing of the gap between the hoop members. Also, at the ends of the hoop members, there is located a spacer (at each end) so as to initially pre-establish the width of the gap between the hoop members. Also, the hoop members are readily bendable so that the ends of the hoop members can be readily moved slightly toward each other to faciliate positioning of the quilt in a taut manner within the area confined by the hoop members.

The primary objective of the present invention is to construct a border hoop that is to be used in quilting that permits the border hoop to be utilized with practically any reasonable thickness of quilt and to be adjustable for that thickness of quilt.

DETAILED DESCRIPTION OF THE PREFERRED EMBODIMENT

Figure 1:
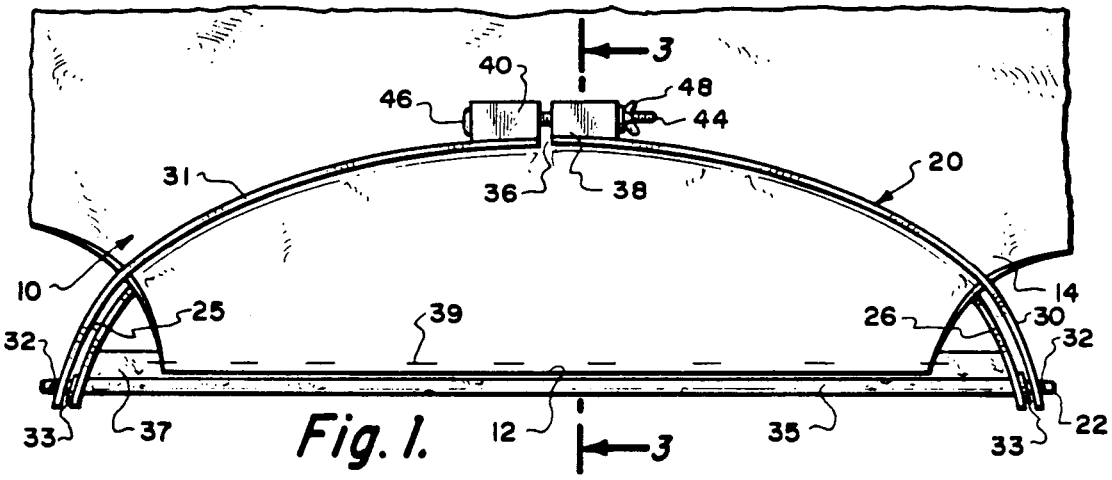
FIG. 1 is a top plan view of the border hoop of the present invention showing such connected with the border of a quilt.

Referring particularly to the drawings, there is shown a quilt 10 which is composed of an outer layer of material 14 and an inner layer of material 16 with a stuffing 18 being supported therebetween. A typical stuffing would be a cotton, polyester or other similar type of material. Fabric 14 and 16 can comprise any type of natural or synthetic material. This quilt 10 terminates in a straight line border 12 when it is desired to effect sewing (not shown) of the quilt 10 in the area of the straight line border 12, the user will normally require the use of a border hoop 20 that confines a portion of the quilt 10 in a taut manner within the area confined by the border hoop 20.

The border hoop 20 includes a cylindrical shaped support rod 22 which will generally be in the form of a dowel. The dowel 22 can be constructed of any rigid material with generally wood material being preferred. Draped around the dowel 22 is a fabric layer 35 which extends substantially the entire length of the dowel 22. This fabric layer 35 includes an outward extending flange 37. The border 12 of the quilt 10 is to be temporarily secured through the flange 37 by means of a series of elongated stitches 39. The securing of the quilt 10 to the flange 37 is what is commonly referred to as basting.

Mounted on the dowel 22 is a first U-shaped member 26. The member 26 will normally be constructed of wood and will be thin and will be substantially wider than it is thicker. In essence, the member 26 will resemble a barrel stave. The member 26 terminates in ends and directly adjacent each end there is located a hole 24. The support rod 22 is conducted through these holes 24.

A similar hoop member, formed of a pair of members 30 and 31, has a pair of ends and within each end is located a hole 28. Again, the support rod 22 is located through the holes 28. The U-shaped member formed of members 30 and 31 is slightly longer in length than U-shaped member 26. Therefore, when the members 26 and 30–31 are in juxtaposition, there is formed a gap 25 therebetween.

Formed in each end of the dowel 22 is a hole within which is located a pin 32. Each pin 32 is fixedly secured in position by a layer of glue 34. One of the pins 32 is to rest against the outside surface of the member 30 with the other pin 32 resting against the outside surface of member 31.

There is formed a gap 36 between the members 30 and 31. This gap 36 can be made larger or smaller by means of an adjusting block assembly which includes in part a wood block 38 mounted on the exterior surface of member 30 and a wood block 40 mounted on the exterior surface of the member 31. Through the wood block 38 is a located a hole 42 through which is conducted a threaded blot 44. A similar hole (not shown) is formed within the block 40 and again the threaded fastener 44 is conducted through that hole with the enlarged head 46 of the fastener 44 abutting against the block 40. Connecting with the threaded end of the threaded fastener 44 is a wing nut 48 with this wing nut 48 being adapted to engage against the block 38.

It can thus be seen that by tightening of wing nut 48 that the blocks 38 and 40 will be moved toward each other thereby diminishing the width of the gap 36. This diminishing of the gap 36 results in narrowing of the gap 25. It is desirable to have the quilt 10 to assume a snug position within the gap 25. If this snug position is not obtained, the operator only is to tighten wing nut 48 which will then diminish the size of the gap 25 to achieve this snug position. If perchance the snugness is too great, the user is to loosen wing nut 48 thereby widening of the gap 25 thereby obtaining of the desired snug securing of the quilt 10 within the border hoop 20.

It is important that in the area of the support rod 22 that member 30 be initially spaced from the member 26 and member 31 be initially spaced from member 26. In order to obtain this, there is mounted on the support rod 22 a pair of spacers in the form washers 33. The washer 33 have a certain thickness and it is this thickness that determines the thickness of the gap 25 in the area of the washers 33. It is to be understood that by increasing or decreasing the size of the washer 33 the initial size of the gap 25 in this area can be varied. However, once the size of washers 33 is selected for a particular hoop 20, it is not varied since pins 32 are permanently installed on dowel 22. If border hoop 20 was to be used in conjunction with a rather substantially thick quilt 10, then rather thick washers 33 would be utilized. However, if the border hoop 20 is to be utilized in conjunction with a rather thin quilt 10 then the washers 33 may be quite thin. But, a thick quilt 10 could be utilized with thin washers 33 with the ends of member 26 sliding on dowel 22 away from the washers 33 enlarging gap 25 to accommodate the greater thickness of quilt 10.

Figure 2:
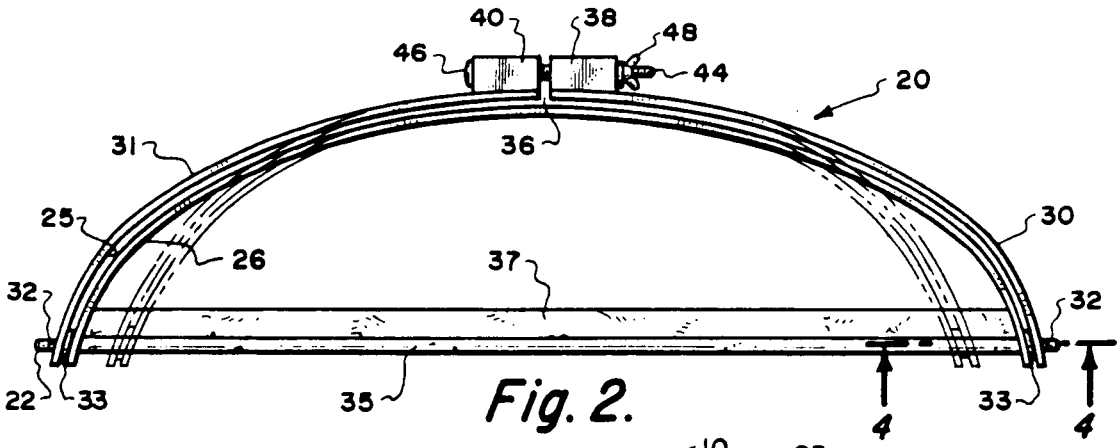
FIG. 2 is a view of the border hoop of the present invention, similar to that of FIG. 1, but showing the border hoop without the quilt being mounted therein.
Figure 3:
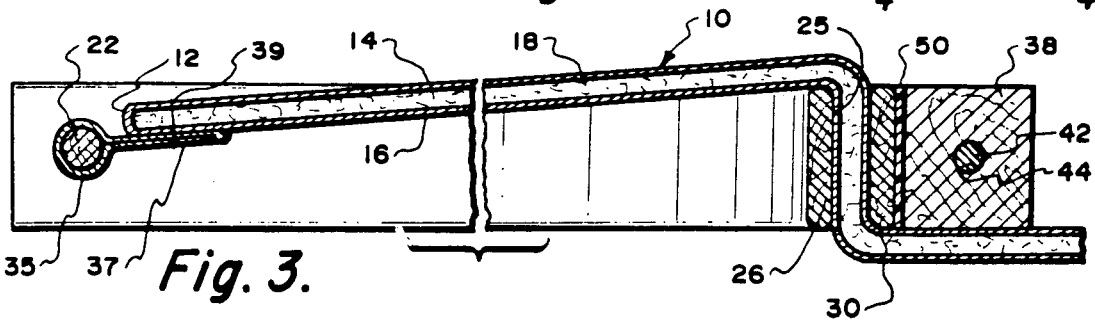
FIG. 3 is a cross-sectional view through the border hoop of the present invention taken along line 3—3 of FIG. 1.
Figure 4:
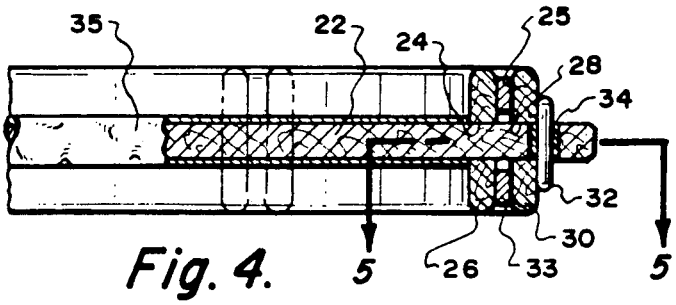
FIG. 4 is a cross-sectional view taken along line 4—4 of FIG. 2 showing in more detail the connection arrangement between the border hoop U-shaped members and the support rod.
Figure 5:
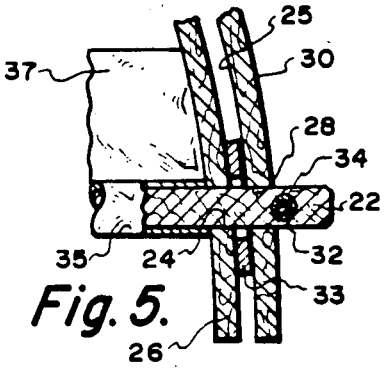
FIG. 5 is a cross-sectional view taken along line 5—5 of FIG. 4.

During the time that the quilt 10 is being installed in position in conjunction with the border hoop 20, it may be desirable to expand outwardly the member 26 as well as members 30 and 31. This expansion outwardly is to be achieved simultaneously and can be done by sliding of the members 26, 30 and 31 on the support rod 22 in an inward direction as depicted in the phantom lines within FIG. 2. During this expansion, the blocks 38 and 40 will actually move outward from what is shown in FIG. 2 away from the support rod 22. However, this outward expansion is not precisely shown as it would be confusing within the illustration of the drawing.

What is claimed is:

1. A quilting border hoop comprising:

an elongated support rod having a pair of opposite ends, a fabric strip mounted on said support rod;

a first U-shaped member having free ends mounted on said support rod, said first U-shaped member being pivotable and longitudinally slideable on said support rod;

a second U-shaped member having outer ends mounted on said support rod, said second U-shaped member being locatable in juxtaposition with said first U-shaped member forming a narrow gap therebetween, said narrow gap having a width, wherein a quilt is to be bindingly located within said narrow gap by a binding force with a portion of the quilt being stretched and held taut across an area confined by said second and first U-shaped members with an edge of the quilt being temporarily secured to said fabric strip; and a spacer located between each said free end and the directly adjacent said outer end, the selected thickness of said spacers functioning to pre-establish said width of said narrow gap.

2. The quilting border hoop as defined in claim 1 including:

said second U-shaped member comprising a pair of members, an adjusting block arrangement being mounted on said pair of members, said pair of members being movable relative to each other by said adjusting block arrangement, said adjusting block arrangement varying the width of said narrow gap for controlling the binding force against the quilt.

3. The quilting border hoop as defined in claim 2 wherein:

said first U-shaped member being readily bendable so that said free ends are movable toward one another by sliding along said support rod, said second U-shaped member being readily bendable so that said outer ends are movable toward one another by sliding along said support rod.

4. The quilting border hoop as defined in claim 3 wherein:

said elongated support rod is cylindrical.

5. The quilting border hoop as defined in claim 4 wherein:

said first U-shaped member having a cross-sectional configuration, said second U-shaped member having a cross-sectional configuration, said cross-sectional configuration of said second U-shaped member being identical to said cross-sectional configuration of said first U-shaped member.

6. The quilting border hoop as defined in claim 5 wherein:

said spacers are of the same size.

7. The quilting border hoop as defined in claim 6 wherein:

each said spacer comprises a washer.

* * * * *